United States Patent [19]

McKann

[11] 4,430,836

[45] Feb. 14, 1984

[54] FRAME ASSEMBLY FOR DOOR LIGHT

[75] Inventor: H. Smith McKann, Fredericksburg, Va.

[73] Assignee: General Products Co., Inc., Fredericksburg, Va.

[21] Appl. No.: 389,887

[22] Filed: Jun. 18, 1982

[51] Int. Cl.[3] ..... E04F 19/06; E04B 1/62

[52] U.S. Cl. ..... 52/455; 52/403

[58] Field of Search ..... 52/455, 456, 656, 397, 52/402, 403; 49/DIG. 1

[56] References Cited

U.S. PATENT DOCUMENTS

| | | | |
|---|---|---|---|
| 812,467 | 2/1906 | Watkins . | |
| 1,287,888 | 12/1918 | Connell et al. . | |
| 1,947,736 | 2/1934 | Potter | 296/84 |
| 2,365,954 | 12/1944 | Hebestreit | 20/56 |
| 2,402,105 | 6/1946 | Verhagen | 49/DIG. 1 |
| 2,654,920 | 10/1953 | Kessler | 52/402 X |
| 2,767,814 | 10/1956 | Johnson | 189/78 |
| 2,808,355 | 10/1957 | Christie et al. | 52/397 X |
| 2,860,744 | 3/1955 | Mascari | 189/46 |
| 3,004,641 | 1/1959 | Johnson | 189/46 |
| 3,014,560 | 12/1961 | Krauss et al. | 52/397 |
| 3,099,865 | 8/1963 | Burnett | 20/40 |
| 3,191,727 | 6/1965 | Schmeltz et al. | 49/DIG. 1 |
| 3,340,661 | 9/1967 | Krieger | 52/456 |
| 3,381,431 | 5/1968 | Jacobson | 52/309 |
| 3,487,602 | 1/1970 | Braun et al. | 52/455 |
| 3,599,703 | 8/1971 | Mennuto et al. | 160/90 |
| 3,641,721 | 2/1972 | Martin | 52/212 |
| 3,686,814 | 8/1972 | Anderson | 52/456 |
| 3,800,489 | 4/1974 | Boice | 52/208 |
| 3,949,526 | 4/1976 | Sherlock et al. | 49/501 |
| 4,110,948 | 9/1978 | Maier | 52/403 X |
| 4,162,590 | 7/1979 | Earley | 49/55 |
| 4,214,415 | 7/1980 | Sukolics | 49/DIG. 1 |

*Primary Examiner*—J. Karl Bell

*Attorney, Agent, or Firm*—Roylance, Abrams, Berdo & Goodman

[57] ABSTRACT

A frame assembly for mounting a light in a door comprises inner and outer half-frames which sandwich a translucent panel therebetween. Each half-frame is substantially identically formed as a unitary member from sheet metal and has a plurality of substantially identical side members which define a closed polygon. Fasteners couple the half-frames to each other and secure the half-frames in the opening in the door. The fasteners can include a plurality of externally threaded fasteners which extend through holes in the half-frames and a plurality of plastic tubular retainers. Each tubular retainer has an axially extending bore coaxially aligned with one of the holes in each of the half-frames and threadedly receiving two of the fasteners in its opposite ends. The unitary nature of the frame and the fastener arrangement facilitate manufacture and assembly, while the fastener arrangement additionally provides a thermal break between the metal half-frames.

16 Claims, 10 Drawing Figures

FRAME ASSEMBLY FOR DOOR LIGHT

The present invention relates to a frame assembly for a metal closure such as a door in which the frame is recessed within the door.

The application is related to my copending U.S. patent application Ser. No. 178,493, filed Aug. 15, 1980, entitled "Metal Door and Light Assembly" now abandoned.

BACKGROUND OF THE INVENTION

Doors used as replacements or for new construction are conventionally produced of sheet metal. When these doors are used as outside entrances, as distinguished from interior doors, it is desirable to have one or more window sections, referred to as lights, formed in the door. Numerous frame assemblies have been proposed for use as door light frames.

These frames comprise inner and outer half-frames which sandwich a translucent panel therebetween and support the panel within an opening formed in the door. Each half-frame is formed separately and has a plurality of side members defining a closed polygon. Usually, the side members of each half-frame are separately formed and then attached together by welding, for example U.S. Pat. No. 3,004,641 to Johnson, or by corner attaching members, for example, U.S. Pat. No. 4,024,691 to Hansen et al and U.S. Pat. No. 3,949,526 to Sherlock et al. These conventional methods of forming the half-frames are difficult, time-consuming and expensive. Additionally, these frames are relatively weak at their side member connections.

Another disadvantage of conventional door frame systems is that they often employ differently formed members for the inner half-frame and the outer half-frame. The use of two different half-frames to form each frame assembly significantly increases manufacturing and assembly costs.

Numerous types of fasteners have been used to secure the half-frames together and to the door. Such arrangements have included threaded fasteners (e.g., French Pat. No. 544,753, U.S. Pat. No. 1,171,444 to Larson et al, and U.S. Pat. No. 3,969,857 to Stark), externally threaded fasteners on one half-frame and internally threaded bores on the mating half-frame (e.g., U.S. Pat. No. 4,128,977 to Schubeis), and mating pin and bore arrangements (e.g., U.S. Pat. No. 3,760,543 to McAllister). These arrangements are disadvantageous since they are difficult to manufacture and assemble, and since they do not provide adequate thermal insulation between the inner and outer half-frames. The thermal insulation problem is particularly significant for metal frames coupled directly by metal fasteners which readily conduct heat between the inner and outer half-frames.

BRIEF DESCRIPTION OF THE INVENTION

Accordingly, an object of the present invention is to provide a frame assembly for a translucent panel which is simple and economical to manufacture and install, and which is of rugged construction.

A further object of the present invention is to provide a frame assembly for a translucent panel which does not protrude beyond the major surfaces of the door in which it is installed, but which is sufficiently secure to be employed in an outside door.

Another object of the present invention is to provide a simple, inexpensive and rugged arrangement for attaching the half-frames of each frame assembly such that the half-frames will be thermally insulated from each other.

Briefly described, the present invention includes a frame assembly for a door light comprising inner and outer half-frames sandwiching a translucent panel therebetween and fasteners for coupling the half-frames and securing the half-frames in an opening. Each of the half-frames is substantially identically formed as a unitary member from sheet metal and has a plurality of substantially identical side members defining a closed polygon. Each of the side members includes, in cross-section, a flat portion for supporting the frame in an opening in a support, a face portion extending in a generally perpendicular direction from the flat portion toward the center of the polygon, and a third portion extending generally inwardly from the face portion toward the other half-frame to abut the translucent panel.

The invention also includes a frame assembly for a translucent panel comprising inner and outer metal half-frames sandwiching a translucent panel therebetween, defining a closed polygon and having a plurality of holes extending therethrough. The frames are attached by a plurality of externally threaded fasteners extending through the holes and by a plurality of plastic tubular retainers. Each retainer has an axially extending bore coaxially aligned with one of the holes in each of the half-frames and threadedly receives two of the fasteners in its opposite ends.

By forming each half-frame substantially identically as a unitary member from sheet metal the side members of each half-frame need not be connected by a separate manufacturing process. This unitary connection is also relatively strong. Moreover, the unitary arrangement of each half-frame permits it to be stamped from sheet metal, thereby minimizing manufacturing costs. Since the inner and outer half-frames are identical, only one set of forming dies are necessary and assembly need not be monitored to ensure that the appropriate half-frame is located on the appropriate side of the door. One or more muntins can also be formed as unitary portions of each half-frame such that the muntin or muntins need not be formed and connected by separate manufacturing processes.

The connection of the half-frames by externally threaded fastener extending through the half-frames and plastic tubular retainers having through bores aligned with respective pairs of holes in the half-frames and threadedly receiving the fasteners is simple, quick and inexpensive to manufacture and assemble, and is rigid. Additionally, the plastic retainer functions as a thermal break between the metal half-frames to prevent the flow of heat therebetween. The internal bore of each retainer can extend entirely through the retainer and be countersunk at its opposite ends to facilitate manufacture and connection of the retainers to the half-frames. Longitudinally extending beads can be formed on the outer surfaces of the retainers to restrict rotation of the retainers when the fasteners are threaded therein. Additional insulation can be provided by insulating members mounted between the half-frames and extending laterally between the retainers.

Thus, a door with the light frame structure of the present invention provides a closure which is relatively simple and inexpensive to manufacture and assemble, is rugged and functions as an efficient insulator. These advantages can also be obtained by employing the frame assembly of the present invention for a sidelight formed adjacent the door in the door frame.

BRIEF DESCRIPTION OF THE DRAWINGS

In order that the manner in which the foregoing and other objects are obtained in accordance with the invention can be understood in detail, particularly advantageous embodiments thereof will be described with reference to the accompanying drawings, which form a part of this specification, and wherein.

DETAILED DESCRIPTION OF THE PREFERRED EMBODIMENTS OF THE INVENTION

Figure 1:
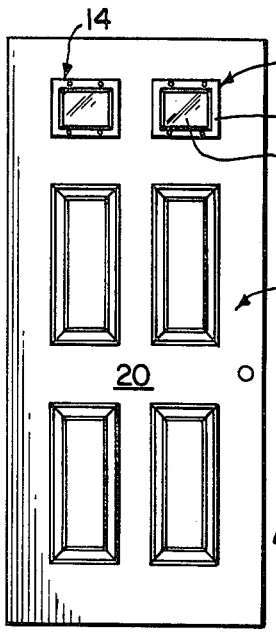
FIG. 1 is a front elevational view of a door with a light frame structure in accordance with one embodiment of the present invention.

Referring initially to FIGS. 1–6, a door 12 according to a first embodiment of the present invention has two separate door lights 14 mounted in the upper portion of the door. Each door light comprises a frame assembly 16 in which a translucent panel 18 is mounted. Although each frame assembly and panel is rectangular, the frame assembly and panel can be of any desired polygonal shape or be curvilinear.

Metal door 12 comprises two generally parallel, metal sheets 20,22 forming the major surfaces of the door and having decorative relief portions formed therein. The sheets are connected by transverse edges with the void between the sheets and edges filled with an insulating foam material. The construction of the door itself is conventional, and thus, is not described in detail.

A rectangular opening 24 is formed in the door for each door light 14. Each side of opening 24 is defined by portions of sheet metal panels 20,22 provided in configurations adapted to receive frame assembly 16. The opening defining portions of each panel comprise a first flange 26 bent perpendicular to the remainder of the panes 20,22 such that such portions extend inwardly toward the opposite panel. Each first flange extends inwardly for a distance less than one-half the thickness of the door providing a space therebetween. A second flange extends perpendicularly from each first flange toward the center of opening 24.

Frame assembly 16 includes an inner half-frame 30 and an outer half-frame 32 which are dimensioned to be received in rectangular opening 24 with translucent panel 18 sandwiched therebetween. Each of the half-frames has substantially the same configuration and is unitarily formed from sheet metal with four side members of substantially identical cross section. The side members include two horizontal members 34 and two vertical members 36.

Each side members has three portions, a flat portion 38, a face portion 40, and a third or inwardly extending portion 42. Each flat portion is adapted to lie in parallel contiguous relationship with one of the first flanges 26 defining opening 24 such that its inner distal edge abuts one of the second flanges 28. Since flat portions 38 are narrower than first flanges 26, the face portions are offset inwardly from the outer surfaces of door panels 20,22. Each face portion extends in a generally perpendicular direction from its flat portion toward the center of the opening. Two countersunk holes 46 extend through the face portion of each of the two horizontal members 34 adjacent their junctures with vertical members 36. The third portions extend generally inwardly from the face portions at obtuse angles toward the opposite side of the door. The third portions have obtusely angled lips 44 at their distal edges which abut translucent panel 18.

Each half-frame is formed as a continuous, unitary member from a single sheet of galvanized metal. The formation of the half-frame from the sheet metal is accomplished by cutting and stamping operations so as to facilitate mass production thereof. Since the half-frames are identical, only one type of half-frame need be formed and care need not be exercised as to which half-frame is placed on the inner surface of the door and which half-frame is placed on the outer surface of the door during assembly.

Translucent panel 18 is of generally conventional configuration comprising two rectangular glass panes 48 separated by an insulating member 50. However, any suitably translucent panel can be supported by the frame assembly of the present invention.

The half-frames are secured to each other in door opening 24 and to translucent panel 18 by eight externally threaded fasteners 52 and four tubular retainers 54. The fasteners extend through holes 46 in half-frames 30,32.

Figure 3:
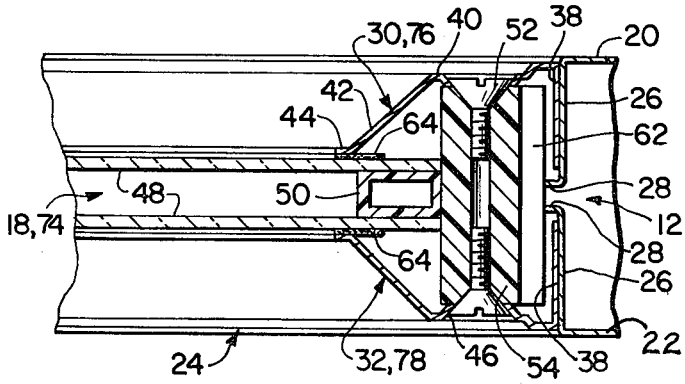
FIG. 3 is a partial, side elevational view in section taken along lines 3—3 of FIG. 2.
Figure 4:
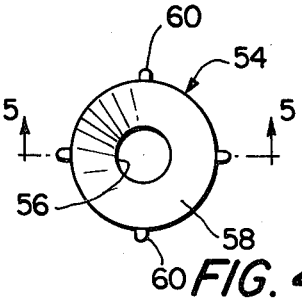
FIG. 4 is a top plan view of a retainer of the light structure of FIG. 1.
Figure 5:
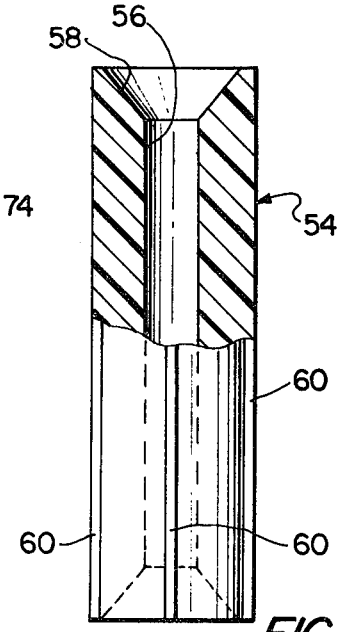
FIG. 5 is a side elevational view in section taken along lines 5—5 of FIG. 4.

Each retainer is generally tubular or cylindrical and is formed of a plastic material, such as polyvinyl chloride or nylon. As illustrated in FIGS. 4 and 5, an axially extending bore 56 extends entirely through the retainer. Alternatively, two separate bores extending inwardly from the opposite axial ends of the retainer can be provided. The axial ends of internal bore 56 are formed with countersinks 58 to assist in aligning screws 52 with bore 56. On the exterior surface of each retainer, a plurality of parallel, axially extending beads 60 project outwardly. As will be explained hereinafter, these beads facilitate assembly of the frame assembly by inhibiting rotation of the retainers during threading of the fasteners in internal bore 56. The material of the retainers permits threads to be formed in bore 56 for threadedly engaging the external threads on fastener 52 by the threading of the fasteners into the bores. As illustrated in FIG. 3, the axial bore in each retainer is coaxially aligned with one of the holes 46 in each of the half-frames such that it threadedly receives two of the fasteners in its opposite ends.

Retainers 54 form a thermal break between inner half-frame 30 and outer half-frame 32 to inhibit the conduction of heat therebetween. Since fasteners 52 are separated by retainers 54, there is no direct metal-to-metal contact by the mechanism securing the half-frames together. The half-frames are also separated and insulated relative to each other by the translucent panel 28 and the glazing material therefor. The metal panels 20,22 of the door are also separated by the space between second flanges 28. Thus, there is no direct metal-to-metal contact by inner and outer members of the door and frame assembly of the present invention such that the door acts as an effective thermal insulator.

To further enhance insulation, insulating blocks or members 62 are mounted between the half frames. These blocks extend laterally between retainers 54 and are sized to substantially fill the space between the peripheral edge of translucent panel 18 and second flanges 28. The insulating blocks can be formed of polystyrene foam (e.g. Styrofoam manufactured by Dow Chemical Company).

Caulking tape 64 provides a seal between half-frames 30,32 and translucent panel 18. The tape has one surface bearing and adhesive which is adhered to the surface of the panel at locations spaced inwardly, but located adjacent the periphery of the panel, such that the edge of the tape closest to the panel center is aligned with the distal edge of lip 44. Typically, the tape is ¼ inch wide and 1/16 inch thick.

During insertion of screws 52 through half-frame holes 46 and into retainer bores 56, retainer beads 62 engage the peripheral edge of the translucent panel and/or insulating block 62 in order to inhibit rotation of the retainers during threading of the fasteners into bore 56. Once the frame assemblies and translucent panels are secured in the door openings, the tops of the screws, which are slightly recessed in the half-frames, and the joint between the half-frames and the door panels can be filled with suitable filler material, e.g., caulk and then painted. Such treatment gives the door a finished and unitary appearance.

Figure 7:
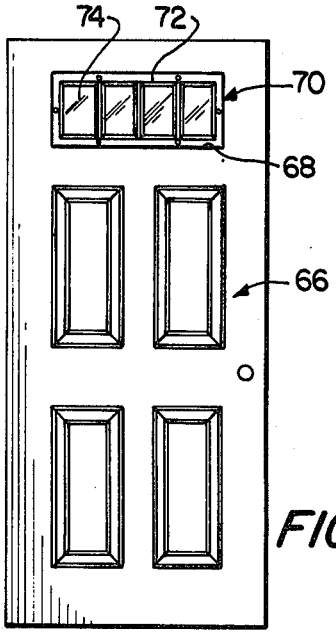
FIG. 7 is a front elevational view of a door and light frame structure according to a second embodiment of the present invention.
Figure 8:
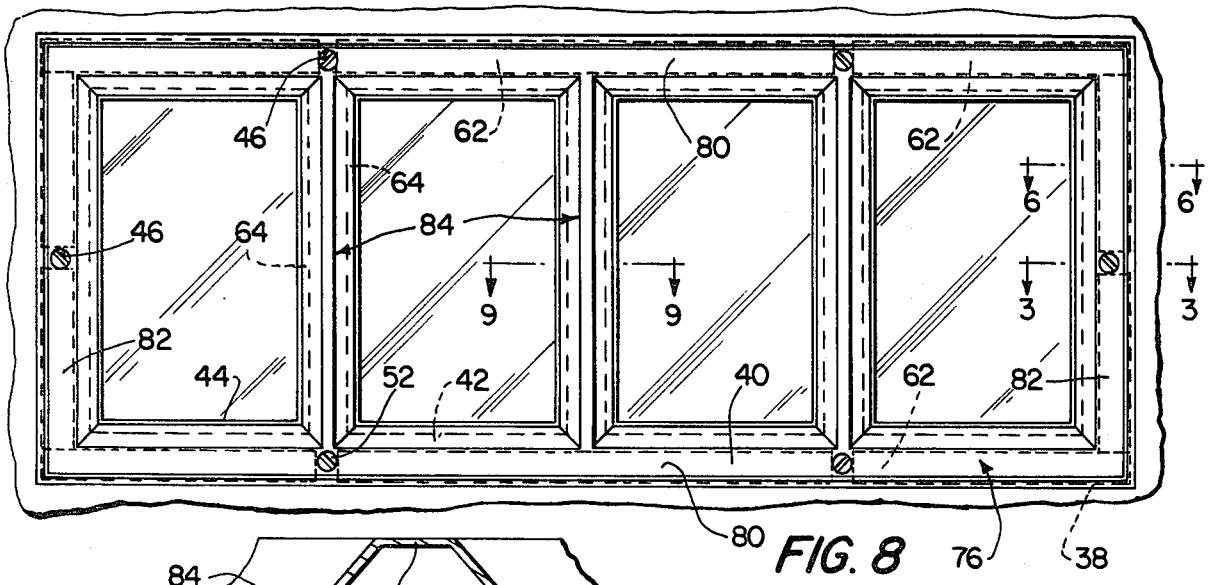
FIG. 8 is an enlarged, partial front elevational view of the light structure of FIG. 7.
Figure 9:
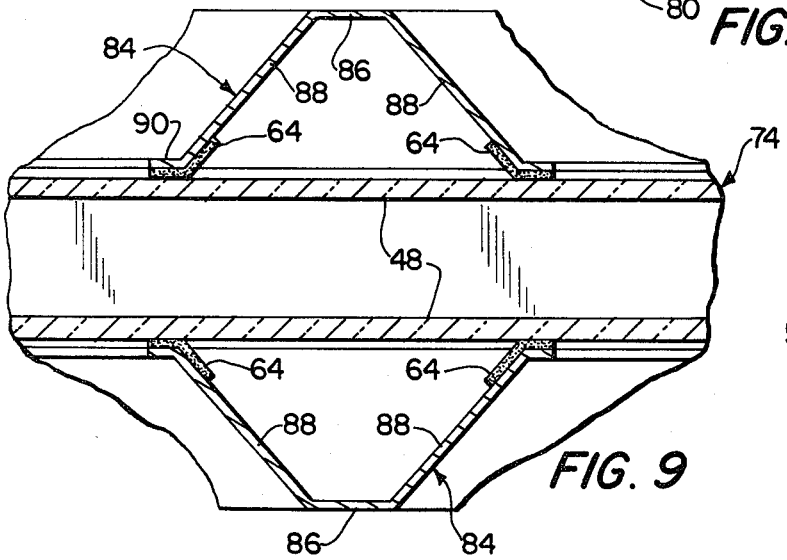
FIG. 9 is an enlarged, partial top plan view in section taken along lines 9—9 of FIG. 8 of the light structure.

A second embodiment of the present invention is illustrated in FIGS. 7–9. The second embodiment involves an elongated frame for forming an elongated door light. The features of the second embodiment which are substantially identical to those of the first embodiment are denoted with the same reference numerals.

Door 66 has a single elongated opening 68 formed adjacent its top portion. An elongated door light 70 comprising a frame assembly 72 and a translucent panel 74 is mounted in door opening 68.

Figure 6:
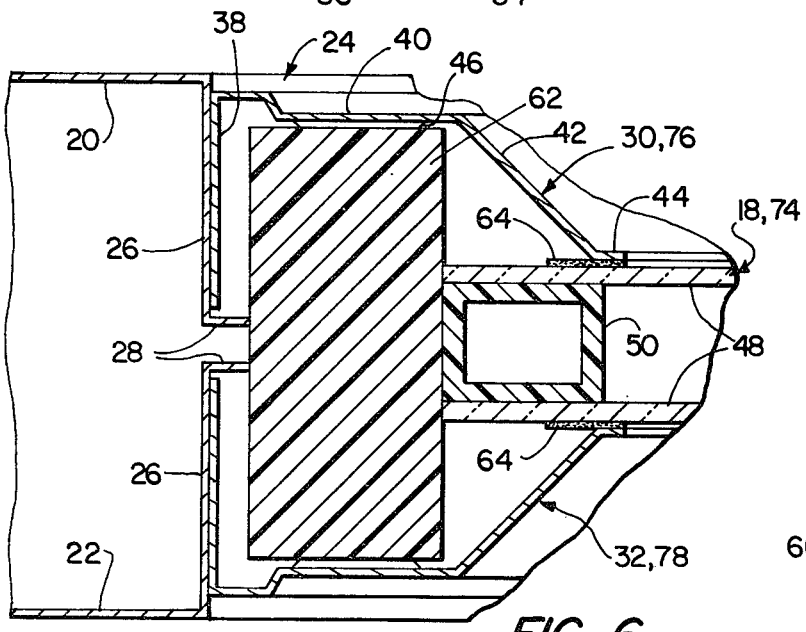
FIG. 6 is a partial, enlarged, top plan view in section taken lines 6—6 of FIG. 2 of the light structure.

Frame assembly 72 comprises an inner half-frame 76 and an outer half-frame 78, with each half-frame having two opposite horizontal members 80 and two opposed vertical members 82. The vertical and horizontal members have a plurality of holes 46 for receiving screws 52. The cross sectional configuration and the attachment of the vertical and horizontal members of half-frames 76,78 are identical to those of the half-frames 30,32 and are illustrated in FIGS. 3 and 6.

Half-frames 76,78 also have muntins which are formed as unitary portions of each half-frame and extend perpendicular to horizontal members 80 and parallel to vertical members 82. The muntins give translucent panel 74 the appearance of comprising several separate panes, even though in fact it extends the entire extent of door light 70. In cross section, each muntin comprises an outer flat portion 86 having inwardly and angularly extending portions 88 extending from the lateral sides thereof. Portions 88 terminate in lips 90 which are sealed to translucent panel 74 by glazing tape 64.

Figure 10:
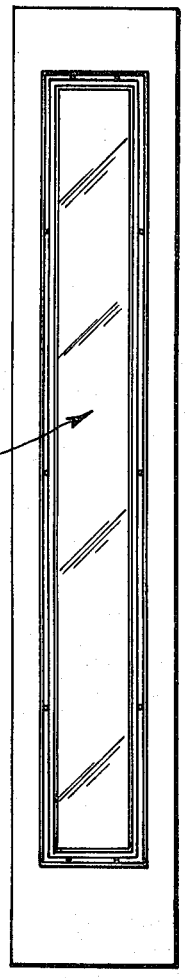
FIG. 10 is a front elevational view of a light frame structure according to a third embodiment of the present invention.
Figure 2:
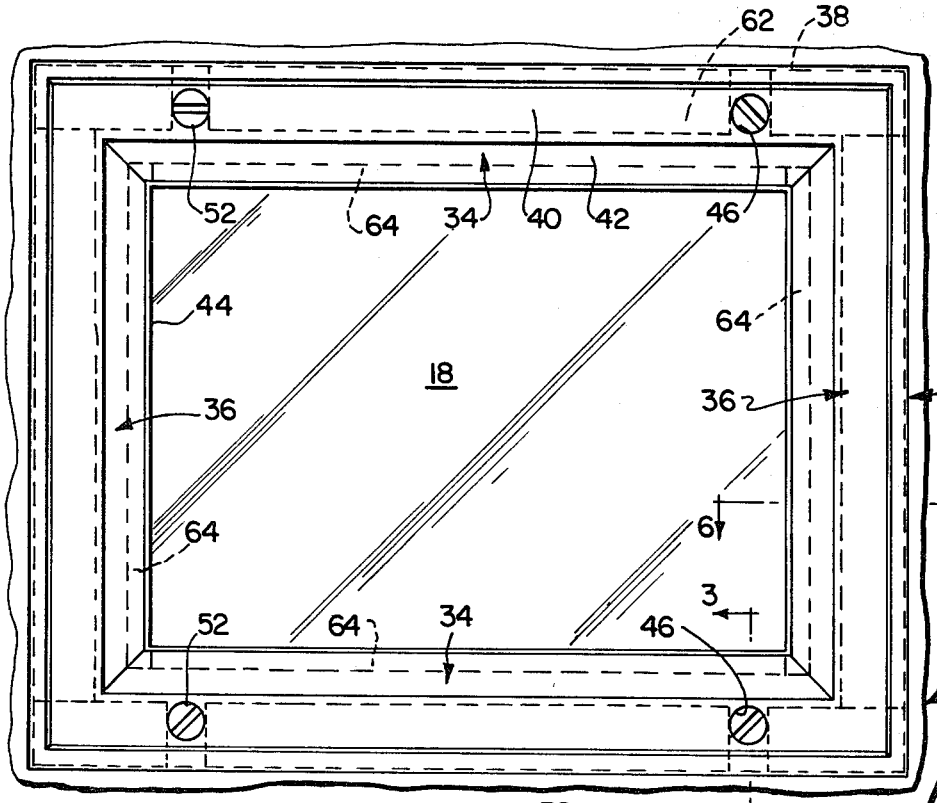
FIG. 2 is an enlarged, partial front elevational view of the light frame structure of FIG. 1.

A third embodiment of the present invention is illustrated in FIG. 10. The door light 92 is elongated in a vertical direction and is of a form suitable for providing a sidelight in a door frame. This sidelight can be provided with or without muntins. The frame assembly and translucent panel of sidelight 92 are formed similarly to the arrangement disclosed for door lights 14,70.

While certain advantageous embodiments have been chosen to illustrate the invention, it will be understood by those skilled in the art that various changes and modifications can be made therein without departing from the scope of the invention as defined in the appended claims.

What is claimed is:

1. A frame assembly for a door light, comprising:

inner and outer half-frames sandwiching a translucent panel therebetween, each of said half-frames being separately and substantially identically formed as a unitary member from sheet metal and substantially uniform thickness and having a plurality of substantially identical side members defining a closed polygon;

each of said side members including, in cross section, a flat portion for supporting the frame in an opening in a support, a face portion extending in a generally perpendicular direction from an edge of said flat portion remote from the other side member toward the center of said polygon, and a third portion extending generally inwardly from said face portion toward the other half-frame to abut said translucent panel; and fastener means, extending through said face portions, for coupling said half-frames and securing said half-frames in the support opening.

2. A frame assembly according to claim 1 wherein each said half-frame has at least one muntin formed as a unitary portion of said half-frame with said side members thereof.

3. A frame assembly according to claim 1 wherein said fasteners means comprises a plurality of holes in said face portions of said half-frames, externally threaded fasteners extending through said holes, and a plurality of plastic tubular retainers, each of said tubular retainers having an axially extending internal bore coaxially aligned with one of said holes in each of said half-frames and threadedly receiving two of said fasteners in opposite ends thereof.

4. A frame assembly according to claim 3 wherein said internal bores extend entirely through said retainers.

5. A frame assembly according to claim 3 wherein said bore of each said retainer has countersinks at the axial ends thereof.

6. A frame assembly according to claim 3 wherein said retainers have longitudinally extending beads on outer surfaces thereof.

7. A frame assembly according to claim 1 wherein insulating members are mounted between said half-frames and extend laterally between said fastener means.

8. A frame assembly for a translucent panel, comprising:

inner and outer metal half-frames sandwiching a translucent panel therebetween, defining a closed polygon and having a plurality of holes extending therethrough;

externally threaded fasteners extending through said holes; and a plurality of plastic tubular retainers, each said retainer having an axially extending bore coaxially aligned with one of said holes in each of said half-frames and threadedly receiving two of said fasteners in opposite ends thereof.

9. A frame assembly according to claim 8 wherein said internal bores extend entirely through said retainers.

10. A frame assembly according to claim 8 wherein said bore of each said retainer has countersinks at the axial ends thereof.

11. A frame assembly according to claim 8 wherein said retainers have longitudinally extending beads on outer surfaces thereof.

12. A frame assembly according to claim 8 wherein insulating members are mounted between said half-frames and extend laterally between said retainers.

13. A door and light frame structure comprising the combination of:

a metal door having parallel sheet metal panels forming the major faces of the door;

means in each of said panels defining a generally rectangular opening, each side of said opening having a portion of each panel shaped to receive the frame structure and including a first flange bent perpendicular to the panel, extending inwardly toward the opposite panel and being no greater than one-half the door thickness, and a second flange bent perpendicular to the first flange and extending toward the center of the opening;

a frame structure including inner and outer rectangular half-frames dimensioned to be received in said rectangular openings with a translucent panel sandwiched therebetween, each of said half-frames being substantially identically formed as a unitary member from sheet metal and having four side members of substantially identical cross section;

each of said side members including, in cross section, a flat portion adapted to lie in parallel contiguous relationship with one of said first flanges of said opening with the inner distal edge of said flat portion abutting one of said second flanges, a face portion extending in a generally perpendicular direction from said flat portion toward the center of the opening and having a plurality of holes extending therethrough, and a third portion extending generally inwardly from said face portion toward the opposite side of the door to abut said translucent panel;

externally threaded fasteners extending through said holes; and a plurality of plastic tubular retainers, each said retainer having an axially extending bore coaxially aligned with one of said holes in each of said half-frames and threadedly receiving two of said fasteners in opposite ends thereof.

14. A door and light frame structure according to claim 13 wherein insulating members are mounted between said half-frames and extend laterally between said retainers.

15. A door and light frame structure according to claim 13 wherein said half-frames are separately formed from sheet metal of substantially uniform thickness.

16. A door and light frame structure according to claim 13 wherein said face portion of each of said side members extends from an edge of said flat portion thereof remote from the other side member.

* * * * *